United States Patent [19]

Horikoshi et al.

[11] 4,069,051

[45] Jan. 17, 1978

[54] SILVER HALIDE PHOTOSENSITIVE ELEMENT SENSITIZED WITH AN INORGANIC BISMUTH COMPOUND AND THE USE THEREOF

[75] Inventors: Akira Horikoshi; Kenro Sakamoto; Toshihiko Koike; Yosuke Sadahiro; Toyohiko Kato, all of Hino, Japan

[73] Assignee: Konishiroku Photo Industry Co., Ltd., Tokyo, Japan

[21] Appl. No.: 680,513

[22] Filed: Apr. 26, 1976

[30] Foreign Application Priority Data

Apr. 30, 1975 Japan ..... 50-52179

[51] Int. Cl.[2] ..... G03C 5/30; G03C 1/28; G03C 1/76

[52] U.S. Cl. ..... 96/66 R; 96/63; 96/108; 96/95; 96/67; 96/76 R

[58] Field of Search ..... 96/108, 95, 110, 66 R, 96/63, 67, 76 R

[56] References Cited

U.S. PATENT DOCUMENTS

| | | | |
|---|---|---|---|
| 3,447,927 | 6/1969 | Bacon et al. | 96/108 |
| 3,615,559 | 10/1971 | Kaspaul et al. | 96/67 |
| 3,852,071 | 12/1974 | Ikenoue et al. | 96/108 |
| 3,901,714 | 8/1975 | Oftedahl | 96/108 |

*Primary Examiner*—Won H. Louie, Jr.
*Attorney, Agent, or Firm*—Haseltine, Lake & Waters

[57] ABSTRACT

A light-sensitive silver halide photographic element containing an inorganic bismuth compound in the emulsion layer and/or constitutive layer and a method for developing said element after imagewise exposure is described.

8 Claims, No Drawings

SILVER HALIDE PHOTOSENSITIVE ELEMENT SENSITIZED WITH AN INORGANIC BISMUTH COMPOUND AND THE USE THEREOF

This invention relates to a light-sensitive silver halide photographic element sensitized by a novel process.

There have heretofore been widely practiced sensitization in which quantum efficiency at exposure is enhanced so as to increase a silver halide photographic emulsion in sensitivity. Well-known is, for instance, so-called noble metal sensitization by incorporating water-soluble noble metal salts into a silver halide emulsion sulfur sensitization by sulfur containing compounds, reduction sensitization by reducing agents, etc. In order to increase the sensitivity of light-sensitive silver halide photographic materials to a greater extent, the above-mentioned sensitization is practically employed in combination with sensitizing methods by so-called development accelerators for increasing or enhancing developability. As representatives of the above methods, there may be mentioned, for example, sensitizing methods by incorporating quaternary ammonium salts or polyalkylene compounds, or combinations thereof into a silver halide emulsion or a developer. These sensitizing methods, i.e. acceleration of development in which a high sensitivity may be obtained, however, have such drawbacks as increased formation of fog. In the sensitizing methods of this kind, there are further involved such drawbacks that the effect obtainable thereby varies depending on the composition of silver halide used or on the kind of developers employed, and various inconveniences to photographic processing or photographic image characteristics, for example, deterioration in graininess due to interaction with other photographic additives.

An object of the present invention is to provide a process for sensitizing light-sensitive silver halide photographic materials and the so-sensitized photographic materials, which process is free from such drawbacks as mentioned above. That is, the primary object of the invention is to provide sensitized silver halide photographic materials and a sensitizing process therefor by acceleration of development, said process not only having a large sensitizing effect but also being less in formation of fog. The secondary object of the invention is to provide a novel sensitizing process, the effect of which does not vary, even when the process is applied to any light-sensitive silver halide photographic materials and to any development processing solutions, without causing any inconveniences due to interaction with other photographic additives. As a result of extensive studies and investigations from the above-mentioned point of view, it has been found that light-sensitive silver halide photosensitive elements are sensitized by incorporating into a light-sensitive silver halide photographic emulsion layer or layers adjacent thereto a bismuth compound hardly soluble to water or aqueous alkaline solutions, whereby developability is increased to make the sensitivity higher. The so-obtained sensitivity is not influenced in addition that any inconveniences due to interaction with other photographic additives do not occur even when said compound is incorporated into any silver halide photosensitive elements and even when the resulting photosensitive elements are processed with any developers.

As the prior art, the use of water-soluble bismuth compounds has been known in silver halide photography. When this water-soluble bismuth compound is incorporated into photographic emulsions of a so-called developing-out type, however, desensitizing effect is rather observed and advantages obtained in the present invention cannot be obtained thereby. On the other hand, there has been also well known a process for the restoration of processing ability of a photographic processing solution, according to which a bismuth compound hardly soluble to water is brought into contact with the photographic processing solution, thereby to control a halogen ion concentration in said processing solution. However, this process aims at the restoration of the photographic processing solution by adsorption of the halogen ions accumulated in said processing solution on the bismuth compound dardly soluble to water in said processing solution. Thus, such process is entirely different in its concept from the present invention which aims at the sensitization of light-sensitive silver halide photographic elements. The present invention is concerned with a novel sensitizing process in which developability is accelerated by means of entirely novel methods in which a bismuth compound hardly soluble to water or aqueous alkaline solutions is incorporated into a silver halide emulsion layer or layers adjacent thereto to sensitive light-sensitive silver halide photographic elements and, at the same time, the technical problems involved in prior art sensitizing processes by the use of development accelerators have been successfully solved.

According to the invention, typical preferred bismuth compounds hardly soluble in water or aqueous alkaline solutions include, for example, bismuth oxide ($Bi_2O_3$), bismuth oxide monohydrate ($Bi_2O_3.H_2O$), bismuth oxide dihydrate ($Bi_2O_3.2H_2O$), bismuth oxide trihydrate ($Bi_2O_3.3H_2O$) and bismuth hydroxide ($Bi(OH)_3$) or the mixed compound thereof. The above-mentioned bismuth compounds must be hardly soluble in water or aqueous alkaline solutions regardless of the solubility to any processing solutions to be used after development.

In applying the above-mentioned bismuth compound to light sensitive silver halide photosensitive elements in accordance with the present invention, the amount of the compound to be incorporated is preferable in general in the range from 0.05 to 5 moles per mole of the silver halide in a photosensitive silver halide emulsion layer, though said amount varies depending on the compound employed, the layer to be incorporated with said compound, the kind of silver halide emulsion layer to be incorporated with said compound, and the photographic characteristics required. Further, the above-mentioned bismuth compounds having an average particle size of 0.01 to 10 $\mu$ may be useful. When light transmission and light scattering properties are considered, a preferable average particle size range is from 0.05 to 1 $\mu$.

The above-mentioned bismuth compound is incorporated into a silver halide emulsion layer of light-sensitive silver halide photographic materials or at least one of the constitutive layers adjacent thereto, for example, a protective layer, intermediate layer, yellow filter layer or antihalation layer. In case the afore-mentioned bismuth compound is incorporated into the silver halide emulsion layer, the compound may be added in the silver halide emulsion at any step during the preparation of the silver halide emulsion, but preferably after completion of a second ripening step or before coating the emulsion on a support. In incorporating such bismuth compounds into a silver halide emulsion layer or layers adjacent thereto of light-sensitive silver halide photosensitive elements, they are generally dispersed first into water or aqueous hydrophilic colloidal solutions by emulsification and then added to the layer. Useful hydrophilic colloids include gelatine, gelatine derivatives, gum arabic, alginic acid, cellulose derivatives, polyvinyl alcohol, polyvinyl pyrrolidone, lysalbic acid and protarbic acid, etc. In the above dispersions, there may also be used, as a dispersing aid, commonly used anionic, amphoteric or non-ionic surface active agent.

The present invention may be effectively applicable to various light-sensitive silver halide photosensitive elements. For instance, Kodacolor type or Kodachrome type silver halide color photosensitive elements, silver halide black-and-white photosensitive elements, silver halide photosensitive elements for X-rays and other silver halide photosensitive elements for radiation, silver halide photosensitive elements for graphic arts, silver halide photosensitive elements using diffusion transfer process and the like.

The photosensitive silver halide emulsions used in the present invention include emulsions of various silver halides such as silver chloride, silver bromide, silver chlorobromide, silver iodobromide and the like. Further, these emulsions may be subjected to chemical sensitization with chemical sensitizers such as sulfur compounds, noble metal salts or reducing compounds and may also be subjected to spectral sensitization in any desired spectral regions with various sensitizing dyes such as cyanine dyes, merocyanine dyes and styryl dyes and the like.

Since the aforementioned bismuth compounds used in the present invention do not cause any inconveniences due to interaction with other photographic additives, the above-mentioned light-sensitive materials may contain various photograhic additives in combination with said bismuth compounds. As the photographic additives usable in combination with said bismuth compounds, there may be employed, for example, such coating aids as saponin, lauryl or oleyl monoether of polyethylene glycol and salts of sulfated or alkylated polyethylene glycol, such stabilizers or inhibitors as triazaindolidine type compounds or mercaptotetrazole type compounds, and such hardeners as halogen-substituted fatty acids, e.g. mucochloric acid or formaldehyde. In the case of light-sensitive color photographic materials to which the present invention is applied, any couplers may be used in combination with the bismuth compound according to the present invention. As these couplers, there may be used, for example, yellow couplers having benzoyl or pivalylacetanilide group, magenta couplers consisting mainly of pyrazolone or indazolone ring or cyanoacetyl group, and cyan couplers of phenol or naphthol nucleus. These couplers may have at the active methylene- or methine-position thereof a halogen atom, arylazo, aryloxy or arylthio group, etc. as substituents which are easily released by color development reaction, and may also have, in the molecule, sulfoxylcarboxyl or a non-diffusion group such as long chain alkyl or alkylphenoxy. These couplers may be incorporated into light-sensitive color photographic materials as by the following procedure in the case of protect type oil-soluble couplers: A solution of the coupler in such high boiling organic solvent as dibutyl phthalate is dispersed in aqueous gelatine solution and the gelatine dispersion is incorporated into an emulsion. Alternatively, the coupler may be dissolved and dispersed in the mixture of chloroform, acetone or dimethylformamide and the dispersion may be incorporated into an emulsion. On the other hand, couplers having a water-soluble group are dissolved in alkaline solution and the resulting solution is incorporated into an emulsion. Further, certain kinds of couplers may be added to a color development solution and this method may also applicable to the practice of the present invention. Particularly preferable light-sensitive color photographic materials capable of enjoying benefit of sensitization by the practice of the present invention are, for example, those which have been disclosed in Nakamura et al. U.S. Patent Application Ser. No. 481701 filed June 21, 1974.

In the light-sensitive silver halide photographic materials to which the present invention is applicable, there may be used any known binders such as gelatine derivatives and polyvinyl alcohol instead of common gelatine for photographic purposes.

Further, supports in the silver halide photosensitive elements may be suitably selected according to the kind of light-sensitive photographic materials to which the present invention is applied, and to the object of uses thereof, however, they may be of any materials such as ordinary paper, laminated paper, glass and natural and synthetic polymer of cellulose acetate, polyester and the like types. These supports may also be subjected, if necessary, to such treatment for rendering them hydrophilic as subbing treatment, thereby to facilitate coating the support with hydrophilic protective colloid and strengthen adhesion of said colloid to said support.

The light-sensitive silver halide photosensitive elements of the present invention are processed by various processing aqueous alkaline solutions. In the case of light-sensitive black-and-white silver halide photographic materials, for example, the photosensitive elements may be developed with a solution containing a black-and-white developing agent consisting of hydroquinones, p-aminophenols, 1-phenyl-3-pyrazolidones, hydroxylamine or the like, and in the case of silver halide color photosensitive elements, the elements of negative type may be developed, for example, with a color developing solution containing such color developing agent as p-phenylene diamine type compounds, and in the case of the elements of positive type, the elements are first developed with a black-and-white developing solution, followed by treatment with the abovementioned color developing solution. Any so-called aftertreatments may be applicable, without particular limitation, to the present invention. In the case of photosensitive black-and-white elements, they may be treated, after development, with a combination of such steps as stopping, acid hardening fixation, stabilizing and water-washing. In the case of color photosensitive elements, they may be treated, after color development, with a bleaching solution or bleach-fixing solution containing such oxidizing agent, for example, as ferricyanide, metal salt of aminopolycarboxylic acids or polycarboxylic acids and, if necessary, may be treated with a combination of such steps as stopping, fixing, water-washing and stabilizing. Further, a known method of amplifying the density of dye image by contact with a processing solution containing hydrogen peroxide or a cobalt complex salt may also be applicable. These treatments may be carried out either at elevated temperatures for rapid processing or at room temperature and, in a special case, at temperatures below the room temperature.

The present invention is illustrated below more concretely with reference to examples which are not intended to limit the scope of the invention.

EXAMPLE 1

A high speed silver iodobromide emulsion (containing 5% mol% of silver iodide) comprising gelatine as a binder was subjected to second ripening and then successively charged with the following:

1. 3% Saponin — 30 ml/mol of AgX
2. Mucochloric acid — 3 mg/g of gelatine

The resulting emulsion was equally divided into four portions.

Subsequently, one of the four portions was incorporated with a 10% aqueous gelatine solution, and the remaining were individually incorporated with a 10% aqueous gelatine solution in which a bismuth compound has been dispersed by emulsification as shown in Table 1. Each portion of the emulsion thus treated was coated on a cellulose triacetate support and then dried to obtain a sample. The sample was exposed, according to the procedure specified in JIS (Japan Industrial Standard), to a predetermined amount of light through an optical wedge and then subjected to development at 20° C. for 4, 8 and 16 minutes, respectively, with a so-called MQ developer as prescribed below. Successively, the developed sample was subjected to acid hardening fixation and water-washing, and then dried and subjected to sensitometry. The results obtained were as shown in Table 1. The relative speed referred to in Table 1 is a value determined by assuming that the speed of the sample free of the bismuth compound determined at the development at 30° C. for 6 minutes was taken as 100.

The respective compositions of the developer and acid hardening fixing solution used in the present example were as follows:

Composition of developer:

| | |
|---|---|
| Methol | 3 g. |
| Anhydrous sodium sulfite | 50 g. |
| Hydroquinone | 6 g. |
| Potassium carbonate (monohydrate) | 29 g. |
| Potassium bromide | 1 g. |
| Water to make | 1,000 ml. |
| Diluted with water, when used, to the proportion of 1 : 1. | |

Composition of acid hardening fixing solution:

| | |
|---|---|
| Ammonium thiosulfate | 150 g. |
| Anhydrous sodium sulfite | 10 g. |
| Potassium alum | 20 g. |
| Glacial acetic acid | 20 ml. |
| Sodium ethylenediamine tetraacetate | 30 g. |
| Water to make | 1,000 ml. |

Adjusted to pH 4.5 with 7N sulfuric acid.

Table 1

| Sample No. | Compound added | Amount of compound added (mole/AgX mole) | Average particle diameter (μ) | Development for 4 minutes Relative speed | Development for 4 minutes Fog | Development for 8 minutes Relative speed | Development for 8 minutes Fog | Development for 16 minutes Relative speed | Development for 16 minutes Fog |
|---|---|---|---|---|---|---|---|---|---|
| 1 | (Control) | — | — | 79 | 0.07 | 100 | 0.09 | 110 | 0.15 |
| 2 | $Bi(OH)_3$ | 0.25 | 0.1 | 150 | 0.06 | 233 | 0.07 | 322 | 0.08 |
| 3 | $Bi_2O_3$ | 0.25 | 0.1 | 115 | 0.06 | 190 | 0.08 | 241 | 0.09 |
| 4 | $Bi_2O_3$ | 0.25 | 0.5 | 105 | 0.06 | 156 | 0.08 | 195 | 0.11 |

As is clear from Table 1, it is understood that samples Nos. 2–4 containing the bismuth compounds according to the present invention have markedly excellent characteristics as compared with the control sample (sample No. 1). That is, each sample obtained according to the present invention shows a substantially very high speed, without appreciable increase in fog even when the development time was prolonged.

Furthermore, there was obtained similar effect even when the bismuth compounds having the same particle diameters as above were individually incorporated, instead of being incorporated into the light-sensitive silver halide emulsion layer, into either the lower or upper layer adjacent to said emulsion layer.

EXAMPLE 2

A high speed silver iodobromide emulsion (containing 3.5 mol% of silver iodide) was subjected to second ripening and then charged with the under-mentioned photographic additives in the following order to obtain a red-sensitive emulsion.

1. The components as prescribed below were formed into a coupler dispersion by means of a high speed rotary mixer, and the dispersion was incorporated into an emulsion containing 1 mole of silver halide.

| | |
|---|---|
| 1-Hydroxy-2-[α-(2',4'-di-tert.-amylphenoxydibutyl)]naphthoamide | 48 g. |
| Tricresyl phosphate | 20 g. |
| Ethyl acetate | 140 g. |
| 3% Gelatine | 700 ml. |
| 5% Sodium dodecylbenzene sulfonate | 100 ml. |
| (2) 3% Saponin | 95 ml/mole of AgX |
| (3) 0.5% Mucochloric acid | 80 ml/mole of AgX |

Subsequently, the thus prepared red-sensitive emulsion was equally divided into two portions, one of which was charged with a 10% aqueous gelatine solution, and the other was charged with a 10% aqueous gelatine solution in which bismuth hydroxide had been dissolved by emulsification in the manner as shown in Table 2. Each portion of the emulsion thus prepared was coated on a cellulose triacetate support and then dried to obtain a sample. The thus obtained sample was exposed to a predetermined amount of light, according to the procedure specified in JIS, through an optical wedge and then subjected to the following processing steps, followed by sensitometry.

Processing steps: (Treatment temperature: 38° C.)

| | | |
|---|---|---|
| (1) | Color developer: | For periods of time as shown in Table 2. |
| (2) | Bleach: | 6 minutes 30 seconds |
| (3) | Water-wash: | 3 minutes 15 seconds |
| (4) | Fix: | 6 minutes 30 seconds |
| (5) | Water-wash: | 3 minutes 15 seconds |
| (6) | Stabilizer: | 1 minute 30 seconds |

Compositions of the respective processing solutions used in the above processing steps were as shown below.

Composition of color developer:

| | |
|---|---|
| 4-Amino-3-methyl-N-ethyl-N-(β-hydroxyethyl)-aniline sulfate | 4.8 g. |
| Anhydrous sodium sulfite | 0.14 g. |
| Hydroxylamine ½ sulfate | 1.98 g. |
| Sulfuric acid | 0.74 mg. |
| Anhydrous potassium carbonate | 28.85 g. |
| Anhydrous potassium bicarbonate | 3.46 g. |
| Anhydrous potassium sulfite | 5.10 g. |
| Potassium bromide | 1.16 g. |
| Sodium chloride | 0.14 g. |
| Trisodium nitrilotriacetate (monohydrate) | 1.20 g. |
| Potassium hydroxide | 1.48 g. |
| Water to make | 1,000 ml. |

Composition of bleaching bath:

| | |
|---|---|
| Ethylenediamine tetraacetate iron ammonium salt | 100 g. |
| Ethylenediamine tetraacetate diammonium salt | 10 g. |
| Ammonium bromide | 150 g. |
| Glacial acetic acid | 10 ml. |
| Water to make | 1,000 ml. |
| Adjusted to pH 6.0 with ammonia water. | |

Composition of fixing solution:

| | |
|---|---|
| Ammonium thiosulfate | 175 g. |
| Anhydrous sodium sulfite | 10 g. |
| Ethylenediamine tetraacetate diammonium salt | 35 g. |
| Water to make | 1,000 ml. |

Composition of stabilizing solution:

| | |
|---|---|
| Formalin (37.5% aqueous solution) | 15 ml. |
| Konidax (a product produced and sold by Konishiroku Photo Industry Co., Ltd.) | 5 ml. |
| Water to make | 1,000 ml. |

The results obtained were as shown in Table 2. The relative speed referred to in Table 2 was a relative value measured by assuming that the speed of the sample free of the bismuth containing compound determined at the development effected for 4 minuts was taken as 100.

Table 2

| Sample No. | Compound added | Amount of compound added (mole/AgX mole) | Average particle diameter (μ) | Development for 2 minutes Relative speed | Fog | Development for 4 minutes Relative speed | Fog | Development for 8 minutes Relative speed | Fog |
|---|---|---|---|---|---|---|---|---|---|
| 5 | (Control) | — | — | 11 | 0.07 | 100 | 0.10 | 294 | 0.22 |
| 6 | $Bi(OH)_3$ | 0.25 | 0.1 | 20 | 0.05 | 208 | 0.08 | 501 | 0.18 |

As is clear from Table 2, it is understood that even in the case of light-sensitive color photographic materials, the light-sensitive color photographic material sensitized by the process of the present invention shows, in the same manner as in Example 1, markedly excellent photograhic characteristics as compared with the control sample.

EXAMPLE 3

On a support composed of a cellulose triacetate film were successively formed from the support side the following layers to prepare a light-sensitive material-A.

Layer-1 (antihalation layer):

A dispersion of black colloidal silver in an aqueous gelatine solution was coated on the support in such proportions that the gelatine was 3 g/m² and silver 0.3 g/m².

Layer-2 (cyan-forming red-sensitive silver halide emulsion):

A silver iodobromide gelatine emulsion (containing 6 mol% of silver iodide) containing a dispersion prepared by dissolving a mixture of 5 g. of colored cyan coupler (I) and 20 g. of cyan coupler (II) in tricresyl phosphate and dispersed in an aqueous gelatine solution and a dispersion prepared by dispersing 28.6 g. of bismuth hyroxide (particle diameter: 0.1 μ) was coated on the layer-1 formed on the support in such proportions that the gelatine was 4.5 g/m², silver 3.4 g/m², cyan coupler 1.4 g/m² and bismuth hydroxide 2.0 g/m².

Layer-3 (intermediated layer):

An aqueous gelatine solution was coated on the layer-2formed on the support in such proportion that the gelatine was 1.3 g/m².

Layer-4 (magenta-forming green-sensitive silver halide emulsion):

A silver iodobromide gelatine emulsion (containing 6 mol% of silver iodide) containing a dispersion prepared by dissolving a mixture of 5 g. of colored magenta coupler (III) and 25 g. of magenta coupler (IV) in tricresyl phosphate and dispersing the solution in an aqueous gelatine solution and a dispersion prepared by dispersing bismuth hydroxide (particle diameter: 0.1 μ) in an aqueous gelatine solution was coated on the layer-3 formed on the support in such proportions that the gelatine was 5.0 g/m², silver 3.2 g/m², magenta coupler 1.2 g/m² and bismuth hydroxide 1.5 g/m².

Layer-5 (intermediate layer):

An aqueous gelatine solution was coated on the layer-4 formed on the support in such proportion that the gelatine was 1.3 g/m².

Layer-6 (yellow filter layer):

A dispersion of yellow colloidal silver in an aqueous gelatine solution was coated on the layer-5 formed on the support so that the silver was 0.1 g/m² and gelatine 1.3 g/m².

Layer-7 (yellow-forming green-sensitive silver halide emulsion):

A silver iodobromide gelatine emulsion (containing 7 mol% silver iodide) containing a dispersion prepared by dispersing a solution of 30 g. of yellow coupler (V) in dibutyl phthalate in an aqueous gelatine solution was coated on the layer-6 formed on the support so that the gelatine was 4.0 g/m², silver 1.0 g/m² and yellow coupler 1.6 g/m².

Layer-8 (protective layer):

An aqueous gelatine solution was coated on the layer-7 formed on the support so that the gelatine was 1.3 g/m².

Furthermore, each of the above-formed layers was incorporated with 1.2-bis(vinylsulfonyl)ethane as a hardener in an amount of 20 mg. per gram of the gelatine.

Colored cyan coupler (I):

1-Hydroxy-4-[4-(2-hydroxy-3,6-disulfo-1-naphthylazo)anilinocarbonyloxy]-N-[δ-(2,4-di-tert.-amylphenoxy)butyl]-2-naphthamide disodium salt

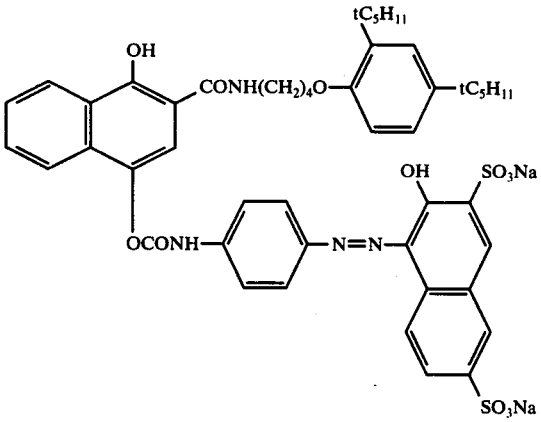

Cyan coupler (II):
2-{4-(2,4-Di-tert.-amylphenoxy)butyl}carbamoyl-1-naphthol

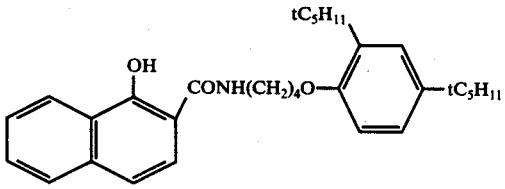

Colored magenta coupler (III):
3-(2-Chloro-5-octadecylsuccinimido-anilino)-1-(2,4,6-trichlorophenyl)-4-(1-naphthylazo)-5-pyrazolone

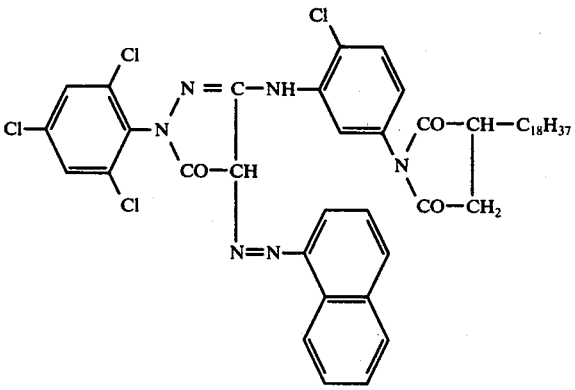

Magenta coupler (IV):
1-(2,4,6-Trichlorophenyl)-3-(3-octadecyl-succinimidobenzamido)-5-pyrazolone

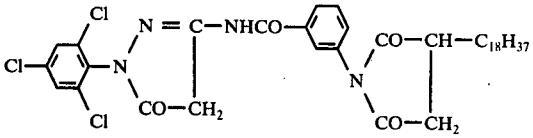

Yellow coupler (V):
α-Succiimido-α-pivalyl-2-chloro-5-[γ(2,4-di-tert.-amylphenoxy)butylamido)acetanilide

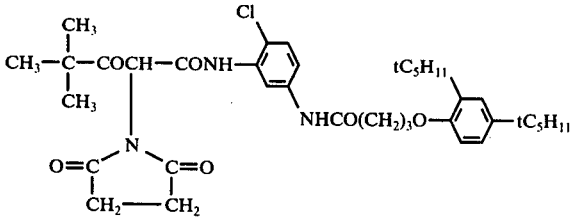

Separately, as a contral light-sensitive material, a light-sensitive material-B was prepared by repeating exactly the same procedure as in the case of the light-sensitive material-A, except that each of the emulsion layers (the layer-2, layer-4 and layer-7) of the light-sensitive material-A was not incorporated with the bismuth hydroxide.

The light-sensitive materials thus prepared were individually exposed, according to the procedure specified in JIS, to a definite amount of light through an optical wedge and then subjected to the following processing steps.

Processing steps: (treatment temperature: 38° C.)

| | | |
|---|---|---|
| (1) | Color developer: | 3 minutes 15 seconds |
| (2) | Bleach-fix: | 3 minutes 15 seconds |
| (3) | Water-wash: | 3 minutes 15 seconds |

Compositions of processing solutions:

| | |
|---|---|
| Color developer: | Same as in Example 2. |
| Bleach-fixing solution: | |
| Ethylenediamine tetraacetic acid iron (III) ammonium salt | 70 g. |
| Ethylenediamine tetraacetic acid diammonium salt | 10 g. |
| Ammonium sulfite | 10 g. |
| Ammonium thiosulfate | 60 g. |
| Ammonium bromide | 200 g. |
| Water to make | 1,000 ml. |
| Adjusted to pH 6.2 with ammonia water. | |

The light-sensitive materials thus treated were individually tested for yellow, magenta and cyan images, respectively, to determine their respective photographic characteristics. The results obtained were as shown in Table 3. In Table 3, Y represents the yellow coupler layer, M represents the magenta coupler layer and C represents the cyan coupler layer. The relative speed referred to in Table 3 was a relative value as measured by assuming that the speed of the yellow coupler layer of the light-sensitive material-B was taken as 100, and the fog was represented by a value obtained by deducing the mask density from the minimum density of unexposed portion.

Table 3

| Light-sensitive material | Relative speed | | | Fog | | |
|---|---|---|---|---|---|---|
| | Y | M | C | Y | M | C |
| B (Control) | 100 | 36 | 27 | 0.18 | 0.16 | 0.13 |
| A | 112 | 50 | 40 | 0.16 | 0.13 | 0.11 |

As is clear from Table 3, it is understood that even in the case of multi-coated color light-sensitive materials, the light-sensitive material sensitized by the process of the present invention have, like the case of Example 2, markedly excellent characteristics as compared with the control light-sensitive material.

EXAMPLE 4

A silver halide emulsion consisting mainly of silver chlorobromide mixed crystal and containing 30 mol% of silver iodide was subjected to chemical sensitization comprising gold sensitization with chloroauric acid in combination with sulfur sensitization with sodium thiosulfate. Thereafter, the emulsion was charged with a sensitizing dye, 1-carboxymethyl-5-[(3-ethyl-2-benzoxazolinylidine]-ethylidene)-3-phenyl-2-thiohydantoin to prepare a light-sensitive lith type emulsion which was then equally divided into two portions.

Separately, one portion of the emulsion thus prepared was incorporated with a dispersion of bismuth hydroxide (particle diameter: 0.1 $\mu$) in a 10% aqueous gelatine solution, and the other portion was incorporated with the same amount of the 10% aqueous gelatine solution to prepare a control emulsion.

Two kinds of light-sensitive lith type emulsion thus prepared were individually coated on a polyethylene terephthalate base and then dried to prepare samples.

The samples thus prepared were individually exposed to light from a tungsten lamp as a light source and then developed and, thereafter, subjected to sensitometry to obtain their relative speed based on the point where a value exceeding by 1.0 above the fog density.

The development was carried out by a three-stage development at 20° C. for 2, 3 and 4 minutes, respectively, by use of a lith developer having the following composition, and the relative speed was measured by assuming that the speed of the control sample as determined at the time of 3 minute-development was taken as 100.

Developer:

| | |
|---|---|
| Formaldehyde-sodium sulfite addition product | 50 g. |
| Hydroquinone | 20 g. |
| Sodium Carbonate | 80 g. |
| Boric acid | 10 g. |
| Potassium bromide | 2 g. |
| Water to make | 1 liter |

The result obtained were as shown in Table 4.

Table 4

| Sample | Amount of $Bi(OH)_3$ added (mole/AgX mole) | Relative speed 2 min. | 3 min. | 4 min. | Fog 2 min. | 3 min. | 4 min. |
|---|---|---|---|---|---|---|---|
| Control | — | 30 | 100 | 150 | 0.01 | 0.01 | 0.02 |
| Present invention | 0.20 | 92 | 134 | 168 | 0.01 | 0.01 | 0.01 |

As is clear from Table 4, it is understood that the light-sensitive material subjected to sensitization according to the present invention shows markedly excellent characteristics as compared with the control sample.

EXAMPLE 5

On a cellulose triacetate support was coated a dispersion comprising a solution of a magenta dye developing agent, 2-p-($\beta$-hydroquinonylethyl)-phenylazo-4-isopropoxy-1-naphthol in an aqueous gelatine solution so that the amount of the coated dye developing agent was 0.75 g. per square meter of the support. On the layer thus formed was coated a green-sensitive silver iodobromide emulsion so that the amount of the coated silver was 0.9 g/m$^2$. This emulsion layer had been charged with a dispersion comprising 0.1 g/g AgX of 4'-methylphenylhydroquinone dissolved in diethyl laurylamide and then with a dispersion of 0.6 g/g AgX of bismuth hydroxide in an aqueous gelatine solution. The light-sensitive material thus prepared was called a negative material-A. On the other hand, as a control sample a negative material-B was prepared by repeating exactly the same procedure as in the case of the negative material-A, except that the bismuth hydroxide was not contained in the green-sensitive silver iodobromide emulsion layer.

Subsequently, on a baryta paper subbed with cellulose nitrate was coated a partial butyl ester of a polyethylene-maleic anhydride copolymer prepared by refluxing for 14 hours 300 g. of highly viscous polymer (ethylene/maleic anhydride), 140 g. of N-butyl alcohol and 1 cc. of 85% phosphoric acid so as to form thereon a layer of about 16 $\mu$in thickness, thereby to provide thereon a neutral layer of typical diffusion transfer image-receiving element.

On the outer surface of the neutral layer thus formed was coated a 4% aqueous polyvinyl alcohol solution to form a polymer spacer layer of about 7 $\mu$ in thickness. On the outer surface of the spacer layer thus formed was coated a 2:1 by weight mixture of polyvinyl alcohol and poly-4-vinylpyridine in the proportion of about 6 g/m$^2$ to prepare an image-receiving polymer layer. The thus prepared image-receiving element was heated at 80° C. for 30 minutes and then cooled.

The negative materials-A and -B prepared in the manner mentioned above were individually exposed, according to the procedure specified in JIS, to light through and optical wedge and treated with an aqueous liquid processing composition having the following composition:

| | | |
|---|---|---|
| Water | 100 | ml. |
| Potassium hydroxide | 11.2 | g. |
| Hydroxycellulose | 3.9 | g. |
| Potassium thiosulfate | 0.5 | g. |
| Benzotriazole | 3.5 | g. |
| N-benzyl-$\alpha$-picolinium bromide | 2.0 | g. |

In practicing the treatment, the image-receiving layer was laid on top of the negative material and the processing liquid was spread out therebetween. One minute after, the image-receiving layer was peeled off from the negative material, whereby a positive image of the magenta dye was obtained on the image-receiving sheet, the more exposed portions of said image was low in density and the less exposed portions of said image was high in density. The results obtained were as shown in Table 5. (The relative speed referred to in Table 5 was a relative value measured by assuming that the speed of the control negative material-B as determined was taken as 100.)

Table 5

| Negative material | Relative speed | Maximum density |
|---|---|---|
| A | 128 | 2.9 |
| B (control) | 100 | 2.7 |

As is clear from Table 5, it is understood that even in the case of light-sensitive color materials of diffusion transfer-type, the negative material-A subjected to the treatment according to the process of the present invention gives not only a high speed but also rather a high density without any decrease in maximum density, as compared with the control sample.

What we claim is:

1. A developing-out type silver halide photosensitive element comprising a support having thereon a silver halide photosensitive emulsion layer and a constitutive layer adjacent to the emulsion layer, having incorporated into the silver halide photosensitive emulsion composition of said emulsion layer an inorganic bismuth compound after completion of a second ripening step during the preparation of the silver halide photosensitive emulsion composition, and before coating the silver halide photosensitive emulsion composition as a layer on said support, and/or having incorporated said bismuth compound into the constitute layer, said bismuth compound is selected from the group consisting of bismuth oxide, bismuth oxide hydrate and bismuth hydroxide, said bismuth compound being present in an amount of 0.05 to 5 moles per mole of the silver halide of the photosensitve element.

2. A silver halide photosensitive element according to claim 1, wherein the bismuth compound is present in the form of grains, the size thereof being less than 10 $\mu$ inclusive in average diameter.

3. A silver halide photosensitive element according to claim 2, wherein the photosensitive emulsion layer comprises the bismuth compound.

4. A silver halide photosensitive element according to claim 1, wherein the bismuth compound is selected from the group consisting of bismuth oxide hydrate, and bismuth hydroxide.

5. A process for developing a silver halide photosensitive element comprising a support having thereon a silver halide photosensitive emulsion layer and a constitutive layer adjacent to the emulsion layer, having incorporated into the silver halide photosensitive emulsion composition of said emulsion layer an inorganic bismuth compound after completion of a second ripening step during the preparation of the silver halide photosensitive emulsion composition, and before coating the silver halide photosensitive emulsion composition as a layer on said support, and/or having incorporated said bismuth compound into the constitutive layer, said bismuth compound is selected from the group consisting of bismuth oxide, bismuth oxide hydrate and bismuth hydroxide, said bismuth compound being present in an amount of 0.05 to 5 moles per mole of the silver halide in the photosensitive element which process comprises imagewise exposing said element to light and immediately thereafter developing said exposed element by treatment with an aqueous alkaline solution containing a silver halide developing agent, thereby obtaining an image.

6. A process according to claim 5, wherein the bismuth compound is present in the form of grains, the size thereof being less than 10 $\mu$ inclusive in average diameter and the photosensitive element comprises the bismuth compound in an amount of 0.05 to 5 moles per mole of silver halide.

7. A process according to claim 6, wherein the photosensitive emulsion layer comprises the bismuth compound.

8. A process according to claim 5, wherein the developing agent is selected from the group consisting of p-phenylenediamines, hydroquinones, p-aminophenol and 1-phenyl-3-pyrazolidones.

* * * * *